US005356268A

United States Patent [19]

Lengyel et al.

[11] Patent Number: 5,356,268

[45] Date of Patent: Oct. 18, 1994

[54] CHECK VALVE STRUCTURES FOR LIQUID RING PUMPS

[75] Inventors: Louis J. Lengyel, Fairfield, Conn.; Ramesh B. Shenoi, Orangeburg, N.Y.

[73] Assignee: The Nash Engineering Company, Trumbull, Conn.

[21] Appl. No.: 128,877

[22] Filed: Sep. 29, 1993

[51] Int. Cl.[5] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,180,613 | 3/1913 | Siemen | 417/68 |
| 1,278,700 | 9/1918 | McFarlane . | |
| 2,344,396 | 3/1944 | Dardalet . | |
| 2,453,373 | 11/1948 | Kollsman . | |
| 3,366,314 | 1/1968 | Schröder | 417/68 |
| 3,721,508 | 3/1973 | Mugele | 417/68 |
| 3,884,596 | 5/1975 | Hoffmeister . | |
| 4,498,844 | 2/1985 | Bissell et al. | 417/68 |
| 5,073,089 | 12/1991 | Trimborn | 417/69 |

FOREIGN PATENT DOCUMENTS

| | | | |
|---|---|---|---|
| 2704863 | 8/1978 | Fed. Rep. of Germany | 417/68 |
| 3935247 | 5/1990 | Fed. Rep. of Germany | 417/68 |
| 55-5427 | 6/1978 | Japan . | |
| 5428 | 1/1980 | Japan | 417/68 |
| 1239405 | 6/1986 | U.S.S.R. | 417/68 |
| 11378 | of 1905 | United Kingdom . | |
| 2064002 | 11/1980 | United Kingdom . | |

*Primary Examiner*—Richard A. Bertsch
*Assistant Examiner*—Roland G. McAndrews, Jr.
*Attorney, Agent, or Firm*—Robert R. Jackson

[57] ABSTRACT

In a liquid ring pump having a port member with at least one auxiliary gas discharge port in addition to the main gas discharge port, an auxiliary gas discharge conduit is provided to extend the auxiliary gas discharge port so that a relatively large check valve can be more easily provided for the auxiliary port. The auxiliary discharge conduit is preferably provided in the head member of the pump, and it preferably extends away from the auxiliary port in a generally radial direction. This allows the check valve to be placed at a less congested location in the pump, which facilitates provision of a larger check valve and also access to the check valve for such purposes as maintenance of the check valve.

20 Claims, 4 Drawing Sheets

10
42
40
22
30
20
32
59b
59
59a
34
32
50
36
2
2
62
60
3
3
24

CHECK VALVE STRUCTURES FOR LIQUID RING PUMPS

BACKGROUND OF THE INVENTION

This invention relates to liquid ring pumps, and more particularly to check valve structures for the auxiliary discharge ports that are sometimes provided in liquid ring pumps.

As shown, for example, in Siemen U.S. Pat. No. 1,180,613, it is known to provide liquid ring pumps with multiple, circumferentially spaced gas discharge ports, the discharge port which is most distant from the gas inlet port in the direction of rotor rotation being the main discharge port, and the other discharge ports being auxiliary discharge ports. It is also known to associate check valves with the auxiliary discharge port or ports so that they open automatically to release gas from the pump when required. When the pump is not compressing gas to the final discharge pressure adjacent to an auxiliary port, the check valve associated with that auxiliary port closes automatically to prevent gas discharged by the pump from re-entering the pump via the closed auxiliary discharge port. Auxiliary discharge ports with check valves may be used for such purposes as preventing unduly high gas pressure in the pump during abnormal operating conditions (e.g., when the pump is first started) and/or extending the operating range of the pump.

In most prior liquid ring pumps with auxiliary discharge ports and check valves, the check valves are located right at the auxiliary discharge ports. Thus in Schroder U.S. Pat. No. 3,366,314, German Offenlegungsschrift 2,704,863, British patent application 2,064,002A, and Japanese patent application 55-5428, for example, the check valve balls or flappers are located right on the side of the port plate or port member which is immediately outside the working portion of the pump. On the other hand, in some "internally ported" liquid ring pumps the check valves are located in the interior of the frustoconical or cylindrical port member that extends into a complementary recess in an axial end of the pump rotor (see, for example, Dardelet U.S. Pat. No. 2,344,396, Kollsman U.S. Pat. No. 2,453,373, British patent 11,378 of 1905, and Japanese patent application 55-5427).

The above-described conventional check valve locations may be undesirable for any of several reasons. The working spaces of the pump vented by the auxiliary discharge ports typically have complicated shapes such as trapezoids or generally trapezoidal shapes with one or more curved sides. Even in the case of internally ported pumps with check valves on the axial end of the port member rather than inside the port member, the auxiliary discharge port passageways typically have trapezoidal cross sections in order to help keep the diameter or circumference of the pump as small as possible. It is difficult to provide check valves for such trapezoidal shapes without somewhat restricting the flow of gas exiting from the pump via those valves even when the valves are open. For example, ball check valves generally require a circular seat, but there may not be room on the axial end face of the port member to provide a circular seat having the same gas flow area as the trapezoidal port to be served by that seat and its associated ball. Indeed, because of the presence of the ball adjacent the seat even when the valve is open, there may be undesirable pressure drop across the check valve unless the flow area through the seat can be made greater than the trapezoidal area leading to the seat. Flapper valves can have a trapezoidal shape, but they require relatively broad seats in order to seal properly and avoid being pulled through their seats by substantial backpressure. A substantial area must also be devoted to mounting the flapper member. Thus again there may not be room at the axial end of the port member for an adequate flapper valve seat and mounting without constricting the associated trapezoidal auxiliary gas discharge port.

Among the disadvantages of locating the check valves inside the port member of an internally ported pump (as in the above-mentioned Dardelet and Kollsman patents, for example) are that doing so makes the check valves relatively inaccessible for maintenance and also tends to be contrary to the objective of keeping the diameter or circumference of the pump as small as possible.

Bissell et al. U.S. Pat. No. 4,498,844 shows a conically ported pump with a vent-recirculation port 76 (FIG. 10) that leads to a conduit 84 in the head member outside the port member. Conduit 84 in turn leads to a liquid sump 100 (FIG. 4) in the bottom of the head member. A further auxiliary vent port 72 may communicate with conduit 84 via check valve 92. Because conduit 84 enters sump 100 below the normal level of liquid in the sump, gas cannot exit from either port 72 or 76 without experiencing some pressure drop associated with passing through the sump liquid.

Mugele U.S. Pat. No. 3,721,508 purports to show pumps with auxiliary discharge ports 13 having check valves 11 at locations remote from the port member. However, the Mugele patent appears to be largely schematic and does not show any attempt to optimize the depicted pumps with regard to such features as circumferential size. Moreover, although check valves 11 have been removed to locations that are remote from the port member, the check valve seats do not appear to be any larger than the ports 13 or conduits 9 leading to them. Check valves 11 can therefore be expected to produce undesirable pressure drops in the gas exiting from the pumps via those valves. This is especially undesirable if the auxiliary ports are provided to extend the normal operating range of the pump rather than only to provide pressure relief during relatively brief periods of abnormal operation.

In view of the foregoing, it is an object of this invention to provide improved check valve structures for liquid ring pumps.

It is a more particular object of this invention to provide check valve structures for liquid ring pumps which include relatively large check valves that do not impede the flow of gas exiting from the pump via the check valve and which check valves can be located for easy maintenance.

SUMMARY OF THE INVENTION

These and other objects of the invention are accomplished in accordance with the principles of the invention by providing a conduit that communicates with each auxiliary gas outlet in the port member of a liquid ring pump. The conduit leads away from the port member to a location where a relatively large check valve can be provided in the conduit. The gas flow area through the check valve is substantially larger than the maximum cross sectional area of the associated auxiliary gas outlet in the port member. Preferably the conduit (1) is formed in the head member that is mounted on the port member, and (2) runs at least partly in a radial direction so that the check valve is disposed at a location that is radially outside of an axial projection of the working spaces in the pump. An access port may be provided in the head member to facilitate access to the check valve for maintenance. Downstream from the check valve the conduit typically joins the main discharge conduit of the pump. The conduits of the pump are preferably shaped so that no body of liquid impedes the flow of gas exiting via the auxiliary port and the associated head member conduit. Multiple auxiliary ports and associated conduits and check valves may be provided.

Further features of the invention, its nature and various advantages will be more apparent from the accompanying drawings and the following detailed description of the preferred embodiments.

DETAILED DESCRIPTION OF THE PREFERRED EMBODIMENTS

Although this invention is equally applicable to liquid ring pumps having other types of port members (e.g., flat port plates as shown, for example, in the above-mentioned Schroder patent, or cylindrical port members as shown, for example, in the above-mentioned Dardelet patent), the invention will be fully understood from the following explanation of its application to an illustrative conically ported liquid ring pump.

Figure 1:
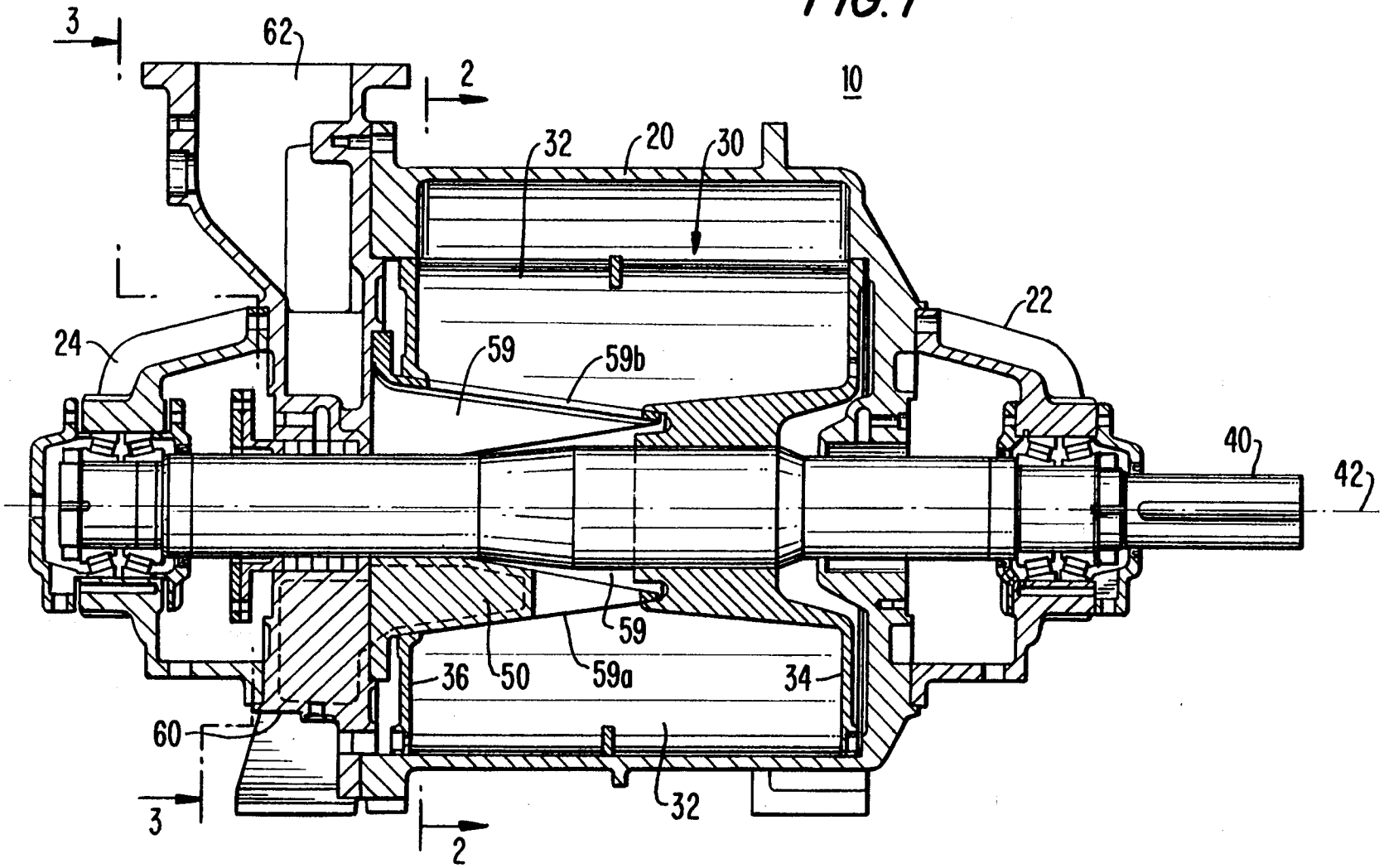
FIG. 1 is a longitudinal sectional view of an illustrative liquid ring pump constructed in accordance with the principles of this invention.

As shown in FIG. 1, an illustrative liquid ring pump 10 constructed in accordance with this invention has a stationary housing 20, the main part of which is a hollow cylindrical annulus. Rotor 30 is mounted on shaft 40 in housing 20 for rotation with the shaft about shaft axis 42. As is conventional in liquid ring pumps, shaft axis 42 is parallel to but laterally offset from the central longitudinal axis of the hollow cylindrical portion of housing 20. Bearing brackets 22 and 24 are secured to the opposite axial ends of the pump to support shaft 40.

Figure 2:
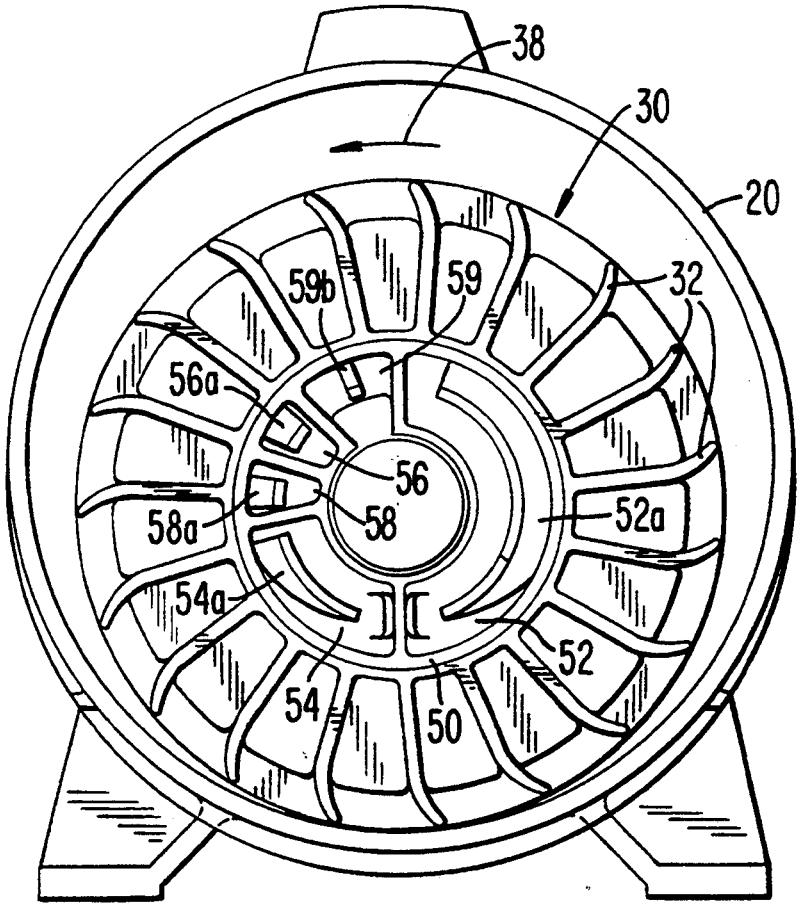
FIG. 2 is a sectional view taken along the line 2—2 in FIG. 1.

Rotor 30 has a plurality of axially and radially extending blades 32 spaced from one another in the circumferential direction around the pump (see also FIG. 2). The axial ends of blades 32 are reinforced by shrouds 34 and 36 which extend angularly around the rotor. When the pump is in operation, rotor blades 32 engage pumping liquid that is maintained in housing 20 and form that liquid into a recirculating annular ring inside the housing.

The left-hand end of rotor 30 as viewed in FIG. 1 has a hollow central recess into which stationary port member 50 extends. Port member 50 is a hollow annular structure mounted on stationary head member 60. Head member 60 is secured to the adjacent axial end of housing 20. Shaft 40 passes rotatably through port member 50 and head member 60. The outer surface of the major portion of port member 50 is frustoconical and mates rotatably with the complementary inner surface of the recess in rotor 30.

Head member 60 has a gas inlet conduit 62 for admitting to the pump gas to be pumped. Inlet conduit 62 communicates with inlet port 52 in port member 50. Inlet port 52 opens to the interior of rotor 30 via aperture **52*a* in port member 50. In this way gas to be pumped enters the working spaces of the pump which are formed between adjacent rotor blades 32 and which are bounded on the inside by the outer surface of port member 50 and on the outside by the inner surface of the above-mentioned pumping liquid ring. Rotor 30, turning in the direction indicated by arrow 38 in FIG. 2, conveys the gas part way around the pump. During this conveyance, the gas is compressed by the inner surface of the liquid ring converging toward the outer surface of port member 50. At the latest (in terms of the time that any given mass of gas remains in pump rotor 30 after leaving the vicinity of inlet aperture 52*a*) the compressed gas exits from the rotor via aperture 54*a* and main discharge port 54 in port member 50. Port 54 communicates with discharge conduit 64 in head member 60** to convey gas from the pump.

In addition to main discharge port 54, port member 50 has two auxiliary discharge apertures **56*a* and 58*a* and associated auxiliary discharge ports 56 and 58 which precede port 54 in the direction of rotor rotation. In particular, in the direction of rotor rotation from inlet port 52, auxiliary discharge port 56 comes first, followed by auxiliary discharge port 58, and then main discharge port 54. Ports 56 and 58 in port member 50 communicate respectively with conduits 66 and 68 in head member 60. Each of conduits 66 and 68 communicates with conduit 64 via a respective one of check valves 76 and 78. Each of these check valves allows gas to flow from the associated auxiliary conduit 66 or 68 to conduit 64, but does not allow gas to flow in the opposite direction (i.e., from conduit 64 into conduit 66 or 68). Thus if pump 10 compresses the gas being pumped to the final discharge pressure adjacent auxiliary discharge port 56, some gas will flow to discharge conduit 64 via port 56, conduit 66, and open check valve 76. Additional gas will flow to discharge conduit 64 via port 58, conduit 68, and open check valve 78. The remaining gas exits via main discharge port 54 and conduit 64. If pump 10 does not compress the gas being pumped to the final discharge pressure until the gas is adjacent auxiliary discharge port 58, check valve 76 will be closed due to the fact that the gas pressure in conduit 64 is greater than the gas pressure adjacent to auxiliary discharge port 56. This prevents discharged gas from re-entering the pump via auxiliary discharge port 56. Some gas is however discharged via auxiliary discharge port 58, conduit 68, and open check valve 78. As still another possible operating condition, the pump may not compress gas to the final discharge pressure until main discharge port 54. In that event, both of check valves 76 and 78 are closed, and gas only exits from the pump via main discharge port 54 and conduit 64**.

For completeness it should be mentioned that port member 50 also provides a bypass conduit 59 for allowing any gas that does not exit via discharge ports 56, 58, and 54 to leave the working spaces of the pump via bypass conduit inlet aperture **59*a* and to re-enter the pump via bypass conduit outlet aperture 59*b*. Aperture 59*a* is between apertures 54*a* and 52*a*. Aperture 59*b* is between apertures 52*a* and 56*a*. The gas in conduit 59** flows through a clearance between port member 50 and shaft 40. By flowing through conduit 59, any gas which was inadvertently not discharged from the pump bypasses intake port 52 and thereby does not reduce the intake capacity of the pump.

It will be noted that to help keep port member 50 as small as possible circumferentially, while still providing the largest possible auxiliary discharge ports 56 and 58, ports 56 and 58 are made with approximately trapezoidal cross sections as shown in FIG. 2. As discussed in the background section of this specification, it is difficult or impossible to provide a check valve for a port with such a shape at the axial end of the port member (i.e., adjacent to head member 60) without restricting the flow of gas in the vicinity of the check valve even when that valve is open. For example, there is not room at this location for a ball-type check valve large enough to avoid a gas flow restriction through the associated circular valve seat and/or around the ball. Similarly, a flapper valve requires a relatively wide seat, and such a seat at this location would partly occlude the associated auxiliary discharge port, thereby restricting the flow of gas from the port even when the valve is open.

Figure 3:
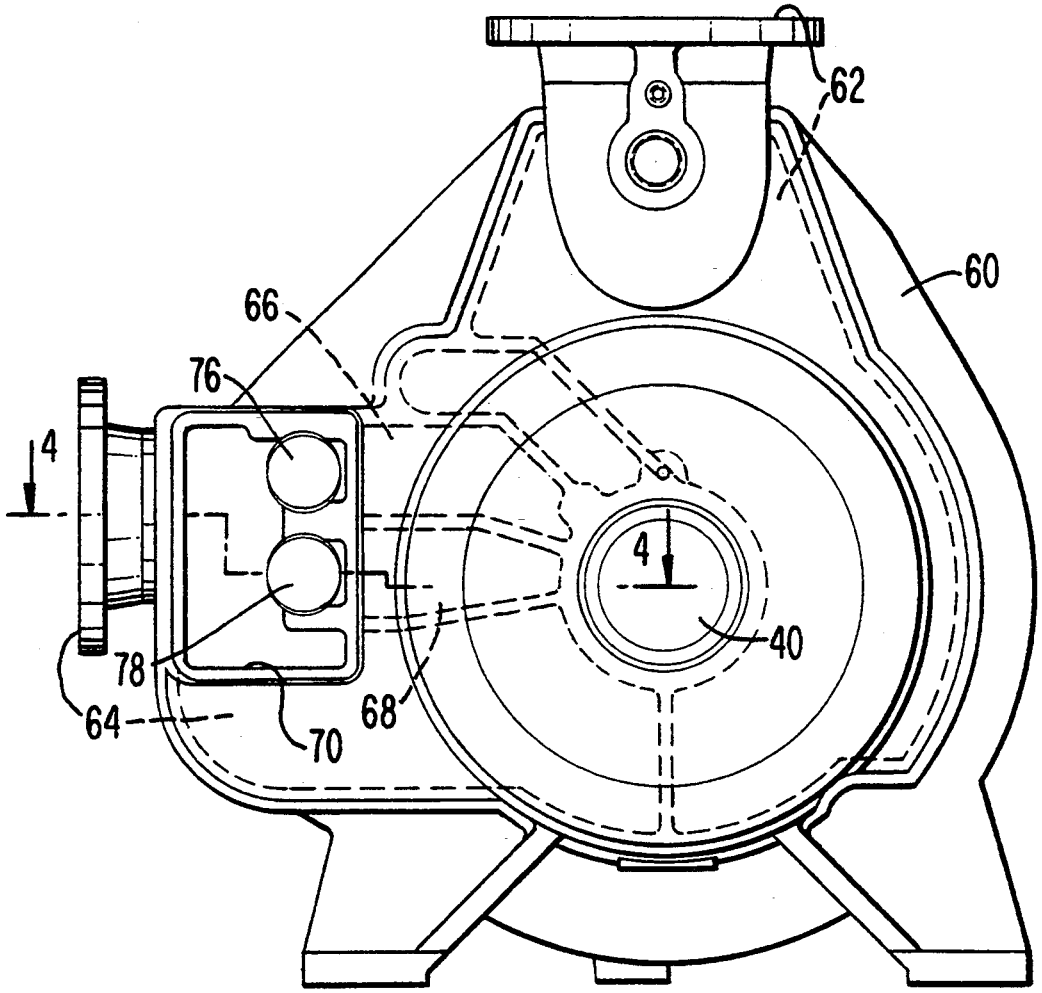
FIG. 3 is a sectional view taken along the line 3—3 in FIG. 1.
Figure 4:
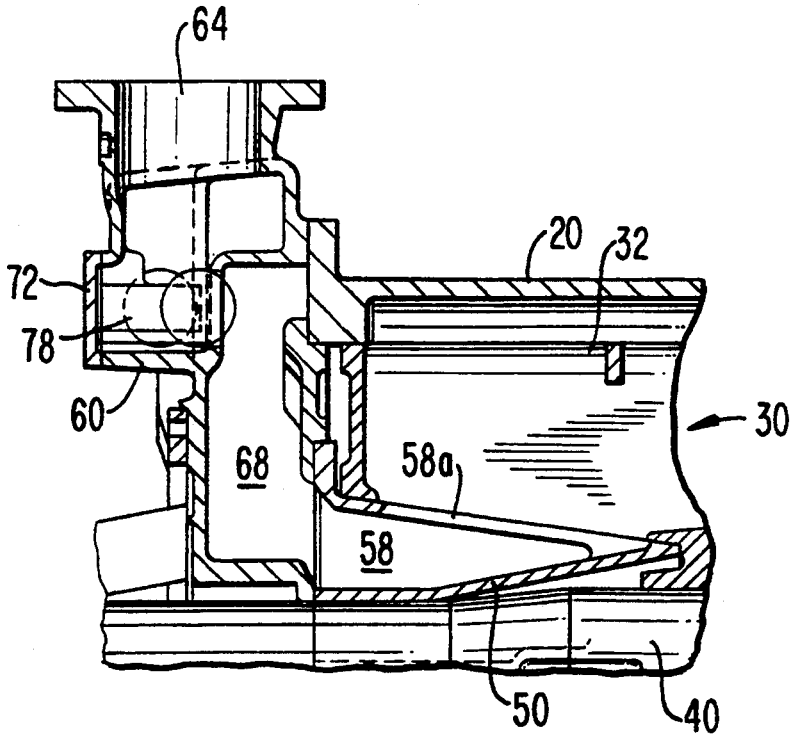
FIG. 4 is a partial sectional view taken along the line 4—4 in FIG. 3.

The pumps of this invention avoid the foregoing restriction of auxiliary discharge ports 56 and 58 by using conduits 66 and 68 in head member 60 to effectively extend ports 56 and 58 to locations where there is much more room to provide check valves. In particular, as can be seen in FIG. 3, each of conduits 66 and 68 extends radially out from the axial end of the associated port 56 or 58 so that check valves 76 and 78 can be disposed at locations that are radially outside an axial projection of the working spaces in the pump. The radial alignment of conduits 66 and 68 has several advantages: (1) it allows conduits 66 and 68 to increase in size in the direction which is circumferential of the pump as the conduits progress radially outward; (2) it facilitates the provision of check valves 76 and 78 that are much larger than could be provided at or adjacent the axial end of port member 50 (in particular, in accordance with this invention the area of the passageway through the seat of each of valves 76 and 78 can be made substantially larger than the cross sectional area of the associated port 56 or 58 in port member 50); (3) it removes check valves 76 and 78 from the more congested area immediately adjacent to shaft 20; (4) it allows conduits 66 and 68 and check valves 76 and 78 to remain in head member 60, thereby avoiding the need for additional axially extending conduits such as are shown in above-mentioned Mugele U.S. Pat. No. 3,721,508; and (5) it facilitates access to check valves 76 and 78 via an access port 70 provided in head member 60 (such access may be desirable for inspection and/or maintenance of check valves 76 and 78; access port 70 typically has a removable cover 72 (FIG. 4)).

As an example of the above-mentioned point that the gas flow area through the seat of each of valves 76 and 78 may be larger than the cross sectional area of the associated auxiliary discharge port 56 or 58, in a pump in which the cross sectional area of each of ports 56 and 58 adjacent to head member 60 is 4.95 square inches, the area through the seat of each of valves 76 and 78 may be 5.94 square inches. This avoids any significant restriction on the flow of gas from ports 56 and 58 due to the presence of check valves 76 and 78. The structures associates with check valves 76 and 78 therefore do not produce any significant pressure drop in the gas exiting from the pump via the auxiliary discharge ports and conduits.

It should also be noted that conduits 66 and 68 are connected (via check valves 76 and 78) to conduit 64 above the level of any possible significant accumulation of pumping liquid in any of these conduits. This also avoids producing any significant pressure drop in the gas exiting from the pump via the auxiliary discharges.

It will be understood that the foregoing is only illustrative of the principles of the invention, and that various modifications can be made by those skilled in the art without departing from the scope and spirit of the invention. For example, although ball type check valves are shown in the drawings, any other type of check valve can be used if desired. Among the suitable alternatives are flapper valves (e.g., as shown in Kollsman U.S. Pat. No. 2,453,373) and check valves in which cylindrical rods rather than balls are used as the valve closing elements (e.g., as shown in Dardelet U.S. Pat. No. 2,344,396). As another example of modifications within the scope of this invention, each auxiliary discharge conduit may be served by several smaller check valve structures rather than just one large check valve as shown in the drawings. For example, each of check valve balls 76 and 78 may be replaced by two or three smaller check valve balls, each with its own seat. However, in accordance with this invention, the sum of the areas through these seats in any given conduit is substantially larger than the cross sectional area of the associated auxiliary discharge port 56 or 58 in port member 50. It will also be apparent to those skilled in the art that whereas the port member 50 shown in the drawings is frustoconical, the principles of this invention are equally applicable to pumps with flat port plates (e.g., as shown in above-mentioned Schroder U.S. Pat. No. 3,366,314) and to pumps with cylindrical port members (e.g., as shown in above-mentioned Dardelet U.S. Pat. No. 2,344,396). The pump shown in the drawings has two auxiliary gas discharge ports 56 and 58 with associated check valves, but only one such port and check valve may be present, or more than two such ports and check valves may be present as desired.

The invention claimed is:

1. A liquid ring pump comprising:

an annular housing having a longitudinal axis and containing a quantity of pumping liquid;

a rotor mounted in said housing for rotation about a rotor axis which is substantially parallel to said longitudinal axis, said rotor having a plurality of radially and axially extending blades spaced circumferentially around the rotor for engaging the pumping liquid and forming it into a recirculating annular ring inside said housing when said rotor is rotated;

a port member adjacent an axial end of said rotor, said port member having a gas inlet port for admitting gas to be pumped to working spaces of the pump bounded partly by adjacent rotor blades and an interior surface of said annular ring of pumping liquid, said port member also having at least two separate gas outlet ports for conveying said gas, after compression by said pump, from said working spaces, said outlet ports being circumferentially spaced from one another and from said inlet port so that a first of said outlet ports precedes a second of said outlet ports in the direction of rotor rotation;

a first conduit communicating with said first outlet port on a side of said port member which is remote from said working spaces;

a second conduit communicating with said second outlet port on said side of said port member which is remote from said working spaces; and mechanical check valve means disposed at a predetermined location in said first conduit for allowing said gas from said first outlet port to flow through said first conduit substantially only in a direction away from said first outlet port by opening said first conduit at said predetermined location to permit gas flow in said direction and by closing said first conduit at said predetermined location to prevent gas flow opposite to said direction, said first conduit communicating with said second conduit downstream from said check valve means, said first conduit having a cross sectional area at said predetermined location which is substantially greater than the cross sectional area of said first outlet port, and said first and second conduits being shaped to substantially prevent an accumulation in said conduits of pumping liquid through which said gas from said first outlet port would have to pass in flowing through said first conduit from said first outlet port into said second conduit.

2. The apparatus defined in claim 1 wherein said first conduit conveys said gas from said first outlet port, which is axially adjacent said working spaces, to said predetermined location, which is radially outward from an axial projection of said working spaces.

3. The apparatus defined in claim 1 further comprising:

a head member on said side of said port member which is remote from said working spaces, said first and second conduits being formed in said head member.

4. The apparatus defined in claim 1 further comprising a closable access port in at least one of said first and second conduits for facilitating access to said check valve means for purposes of maintenance of said check valve means.

5. The apparatus defined in claim 1 wherein said check valve means comprises:

a seat structure having at least one aperture; and a movable valve closure member which bears on said seat structure in order to close said aperture when said check valve means is closed, and which moves away from said seat structure in order to open said aperture when said check valve means is open, the aperture cross-sectional area being substantially greater than the cross sectional area of said first outlet port.

6. The apparatus defined in claim 1 wherein said check valve means comprises a check valve ball.

7. A liquid ring pump comprising:

an annular housing having a longitudinal axis and containing a quantity of pumping liquid;

a rotor mounted in said housing for rotation about a rotor axis which is substantially parallel to said longitudinal axis, said rotor having a plurality of radially and axially extending blades spaced circumferentially around the rotor for engaging the pumping liquid and forming it into a recirculating annular ring inside said housing when said rotor is rotated, said rotor having a hollow interior region which is substantially concentric with said rotor axis and which extends axially into said rotor from at least one axial end of said rotor;

a port member extending axially into said hollow interior region, said port member having an axially extending gas inlet port for admitting gas to be pumped to working spaces of the pump bounded partly by adjacent rotor blades, an interior surface of said annular ring of pumping liquid, and an exterior surface of said port member, said port member also having at least two separate axially extending gas outlet ports for conveying said gas, after compression by said pump, from said working spaces, said outlet ports being circumferentially spaced from one another and from said inlet port so that a first of said outlet ports precedes a second of said outlet ports in the direction of rotor rotation, said first outlet port having a predetermined maximum cross sectional area within said hollow interior region;

a first conduit communicating with said first outlet port outside of said hollow interior region; and check valve means disposed at a predetermined location in said first conduit for allowing said gas from said first outlet port to flow through said first conduit substantially only in a direction away from said first outlet port by opening said first conduit at said predetermined location to permit gas flow in said direction and by closing said first conduit at said predetermined location to prevent gas flow opposite to said direction, said first conduit having a cross sectional area at said predetermined location which is substantially greater than said predetermined maximum cross sectional area.

8. The apparatus defined in claim 7 wherein said first conduit comprises a closable access port adjacent to said check valve means for facilitating access to said check valve means for purposes of maintenance of said check valve means.

9. The apparatus defined in claim 7 wherein said first outlet port has a transverse cross section which is trapezoidal in shape.

10. The apparatus defined in claim 7 further comprising:

a third axially extending gas outlet port in said port member for conveying gas compressed by said pump from said working spaces, said third outlet port being circumferentially intermediate said first and second outlet ports, said third outlet port having a second predetermined maximum cross sectional area within said hollow interior region;

a second conduit communicating with said third outlet port outside of said hollow interior region; and second check valve means disposed in said second conduit for allowing gas to flow through said second conduit substantially only in the direction away from said third outlet port, said second conduit having a cross sectional area at said check valve means which is substantially greater than said second predetermined maximum cross sectional area.

11. The apparatus defined in claim 7 further comprising:

a head member mounted on an axial end of said housing adjacent said one axial end of said rotor, said first conduit being formed in said head member.

12. The apparatus defined in claim 11 wherein said port member is mounted on said head member.

13. The apparatus defined in claim 7 further comprising:

a second conduit communicating with said second outlet port outside of said hollow interior region, said first conduit communicating with said second conduit downstream from said check valve means in a direction away from said first outlet port.

14. The apparatus defined in claim 13 wherein said first conduit is shaped to substantially prevent an accumulation in said first conduit of pumping liquid through which said gas from said first outlet port would have to pass in flowing through said first conduit from said first outlet port to said second conduit.

15. The apparatus defined in claim 7 wherein said first conduit includes a seat structure against which said check valve means bears in order to substantially prevent said gas from said first outlet port from flowing through said first conduit toward said first outlet port, said gas from said outlet port flowing through said first conduit in the direction away from said first outlet port passing through at least one aperture in said seat structure, the cross sectional area of said aperture being substantially greater than said predetermined maximum cross sectional area.

16. The apparatus defined in claim 15 wherein said check valve means comprises a check valve ball.

17. The apparatus defined in claim 16 wherein said aperture is substantially circular.

18. The apparatus defined in claim 7 wherein said first conduit includes a portion which extends in a direction that is approximately parallel to a radius of said rotor, said portion of said first conduit extending from said first outlet port to said predetermined location that is radially beyond an axial projection of said hollow interior region.

19. The apparatus defined in claim 18 further comprising:

a head member mounted on an axial end of said housing adjacent said one axial end of said rotor, said first conduit being formed in said head member.

20. The apparatus defined in claim 19 wherein said port member is mounted on said head member.

* * * * *